US005212735A

United States Patent [19]

Kasatkin et al.

[11] Patent Number: 5,212,735

[45] Date of Patent: May 18, 1993

[54] WIDE-RIBBON LOUDSPEAKER

[76] Inventors: Alexei F. Kasatkin, ulitsa Pravdy, 7/9, kv, 42; Ilya A. Feldman, ulitsa Ostrovityanova, 28, korpus 1, kv. 81, both of Moscow, U.S.S.R.

[21] Appl. No.: 687,906

[22] PCT Filed: Mar. 28, 1990

[86] PCT No.: PCT/SU90/00076

§ 371 Date: Jun. 4, 1991

§ 102(e) Date: Jun. 4, 1991

[30] Foreign Application Priority Data

Sep. 1, 1989 [SU] U.S.S.R. ..... 4737896

[51] Int. Cl.[5] ..... H04R 25/00

[52] U.S. Cl. ..... 381/199; 381/201; 381/203

[58] Field of Search ..... 381/202, 203, 201, 199, 381/190, 191; 29/594, 609.1

[56] References Cited

U.S. PATENT DOCUMENTS

| | | | |
|---|---|---|---|
| 3,564,163 | 2/1971 | Hobrough | 381/202 |
| 3,939,312 | 2/1976 | McKay | 381/202 |
| 4,027,111 | 5/1977 | Kasatkin et al. | 381/202 |
| 4,317,966 | 3/1982 | Lister | 381/202 |
| 4,319,096 | 3/1982 | Winey | 381/200 |
| 4,337,379 | 6/1982 | Nakaya | 381/202 |
| 5,021,613 | 6/1991 | Garcia | 381/203 |

FOREIGN PATENT DOCUMENTS

| | | | |
|---|---|---|---|
| 1604170 | 10/1990 | U.S.S.R. | 381/199 |

*Primary Examiner*—Jin F. Ng
*Assistant Examiner*—Huyen D. Le
*Attorney, Agent, or Firm*—Beveridge, DeGrandi, Weilacher & Young

[57] ABSTRACT

The wide-ribbon loudspeaker comprises permanent magnets 1 forming an open magnetic system, a sound ribbon 3 exposed to the field of the permanent magnets. The permanent magnet 1 has an internal chamber 2 accommodating the ribbon 3 disposed in a plane parallel to the magnet axis, the side walls of the permanent magnet having sound apertures 4 communicating the internal chamber 2 with external space. The degree of the uniformity of the magnetic field in the internal chamber of the magnet is sufficient for using a sound ribbon of any width permitted by the magnet size.

21 Claims, 8 Drawing Sheets

WIDE-RIBBON LOUDSPEAKER

TECHNICAL FIELD

The present invention relates to electroacoustical transducers and, more particularly, to wide-ribbon loudspeakers.

BACKGROUND ART

Known in the art are ribbon loudspeakers comprising permanent magnets, sound-reproducing ribbons made of an electrically conductive material and disposed in the working gaps between the poles or pole pieces of permanent magnets (U.S. Pat. No. 4,319,096).

High sound reproduction fidelity is provided by ribbon loudspeakers, in which the permanent magnets are arranged along an open loop, forming an open magnetic system. In devices of this type the most natural, noise-free operating mode of the sound-reproducing ribbons is attained due to the fact that rearward radiation is not shielded and each ribbon operates independently. These devices are disadvantageous in that the active element of the sound-reproducing ribbon occupies an insignificant part of the loudspeaker area. Another disadvantage is a small width of the employed sound-reproducing ribbons, which is due to a short uniform magnetic field between the poles of the magnets, and it presents a severe problem in obtaining the desired low-frequency sound intensity.

Known in the art is a ribbon loudspeaker (U.S. Pat. No. 4,027,111), selected as a prior art device comprising permanent magnets, forming an open magnetic system, sound-reproducing ribbons made, for example, in the form of corrugated members of an electrically conductive material, each of which is located in the working gap between the poles of the adjacent permanent magnets. The length of the magnets in this device is equal to 60–70 mm, while the working gap width is 7–10 mm. Thus the total area of the sound ribbons is equal to only 5–12% of the total area of the device. The remaining area is occupied by passive, non-sound-radiating side faces of the permanent magnets, which affects the loudspeaker. Still another disadvantage of the prior art device is a low sound pressure in the low-frequency audio range due to the small width of the sound ribbons, hence the poor-quality of sound reproduction.

DISCLOSURE THE INVENTION

An object of the present invention is to provide a wide-band loudspeaker, in which a broader audio-frequency band, higher sound-reproduction quality and greater loudspeaker area, involved into active sound reproduction, will be attained.

This object is attained due to the fact that in the wide-ribbon loudspeaker comprising a permanent magnet with a sound-reproducing ribbon, according to the invention, the permanent magnet comprises an internal chamber accommodating a sound ribbon in a plane parallel to the magnet axis, and side walls of the magnet, which are opposite to the ribbon surface, have sound apertures communicating with the internal chamber of the magnet.

The magnet internal chamber accommodating a sound ribbon considerably improves sound reproduction and increases the active sound-reproducing area of the loudspeaker.

According to the invention, the permanent magnet can be made in the form of an integral construction.

To ensure better sound reproduction, the loudspeaker comprises several permanent magnets with internal-chamber forming an open magnetic system, and the sound ribbon is accommodated in the internal chamber of the magnet and between the unlike poles of the adjacent magnets.

In the proposed loudspeaker, the side walls of the magnet can be assembled of magnetic rods parallely arranged and having their magnetic axes of the same direction, and rows are formed on the ribbon surface side, and in the row the rods are spaced by intervals which function as sound apertures, the rod poles being interconnected by fastening plates of a soft magnetic or nonmagnetic material.

According to the invention, the side walls of the magnet may be also assembled of plates, arranged on the ribbon surface side, and these plates should have apertures to permit sound to pass.

The rods or plates of the loudspeaker are of variable cross-section, which provides for higher uniformity of the magnetic field in the internal chamber of the magnet.

In order to increase the magnet induction in the internal chamber of the magnet and save magnetic material, the loudspeaker comprises several permanent magnets with internal chamber for sound ribbon accommodation. The magnets are arranged so that they face each other with their like poles.

In order to reduce the number of magnetic rods and the weight of the loudspeaker, the magnetic rods forming the side walls of the magnet are, according to the invention, arranged so that the rods of one magnet are located against the intervals between the rods of another, adjacent magnet.

Moreover, according to the invention, the side walls of the magnet are assembled of rods made of a soft magnetic material and magnetized on the both ends by the unlike poles of the magnets.

BRIEF DESCRIPTION OF THE DRAWINGS

The invention will now be described more fully, by way of example, with reference to a particular embodiment thereof, illustrated in the accompanying drawings, in which.

BEST MODE TO CARRY OUT THE INVENTION

Figure 1:
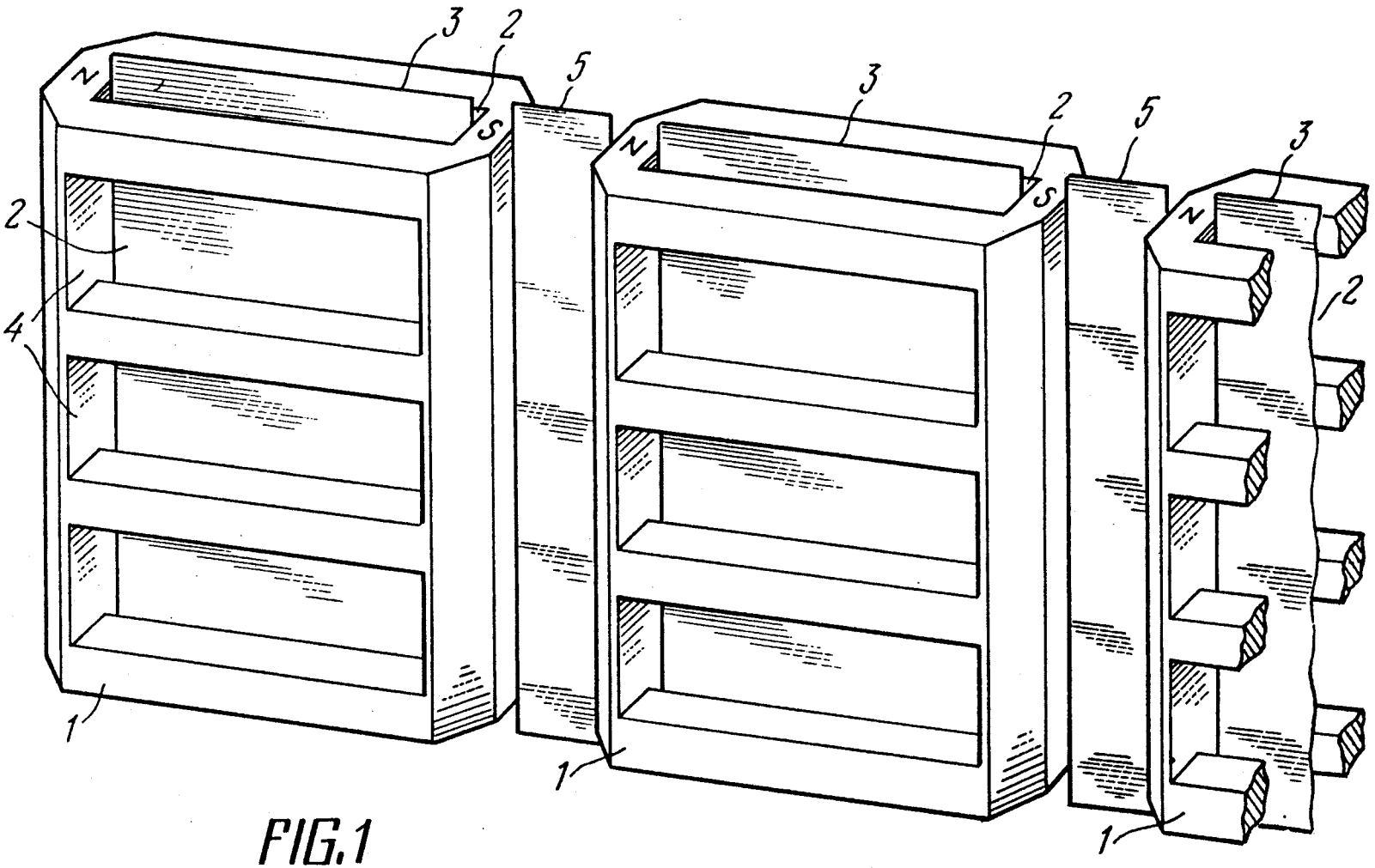
FIG. 1 shows a general view of the loudspeaker, according to the invention.

The proposed wide-ribbon loudspeaker comprises a permanent magnet 1 (FIG. 1) having an internal chamber 2 accommodating a sound ribbon 3, and the side walls of the magnet, facing the surfaces of the ribbon 3, have sound apertures 4 communicating with the internal chamber 2.

The proposed loudspeaker may have several permanent magnets 1 forming an open magnetic system, and in this case the ribbon 3 is accommodated in the chamber 2 and the ribbon 5 between the unlike poles of the adjacent magnets 1, the ribbon 3 accommodated in the chamber 2 being much wider than the ribbon 5 accommodated between the poles of the adjacent magnets. As a matter of convenience, the ribbon 3 will be hereinafter referred to as the wide ribbon and the ribbon 5 as the narrow ribbon. Each of the ribbons is fed with an audio-frequency current in a direction normal to the magnetic axis, which excites sound vibrations of the ribbons. Owing to the polarity of magnetic fields, the currents in narrow and wide ribbons are of directions, which provides for the phase coincidence of the vibrations of all the ribbons.

The permanent magnet shown in FIG. 1 is an integral, e.g. cast construction.

Figure 2:
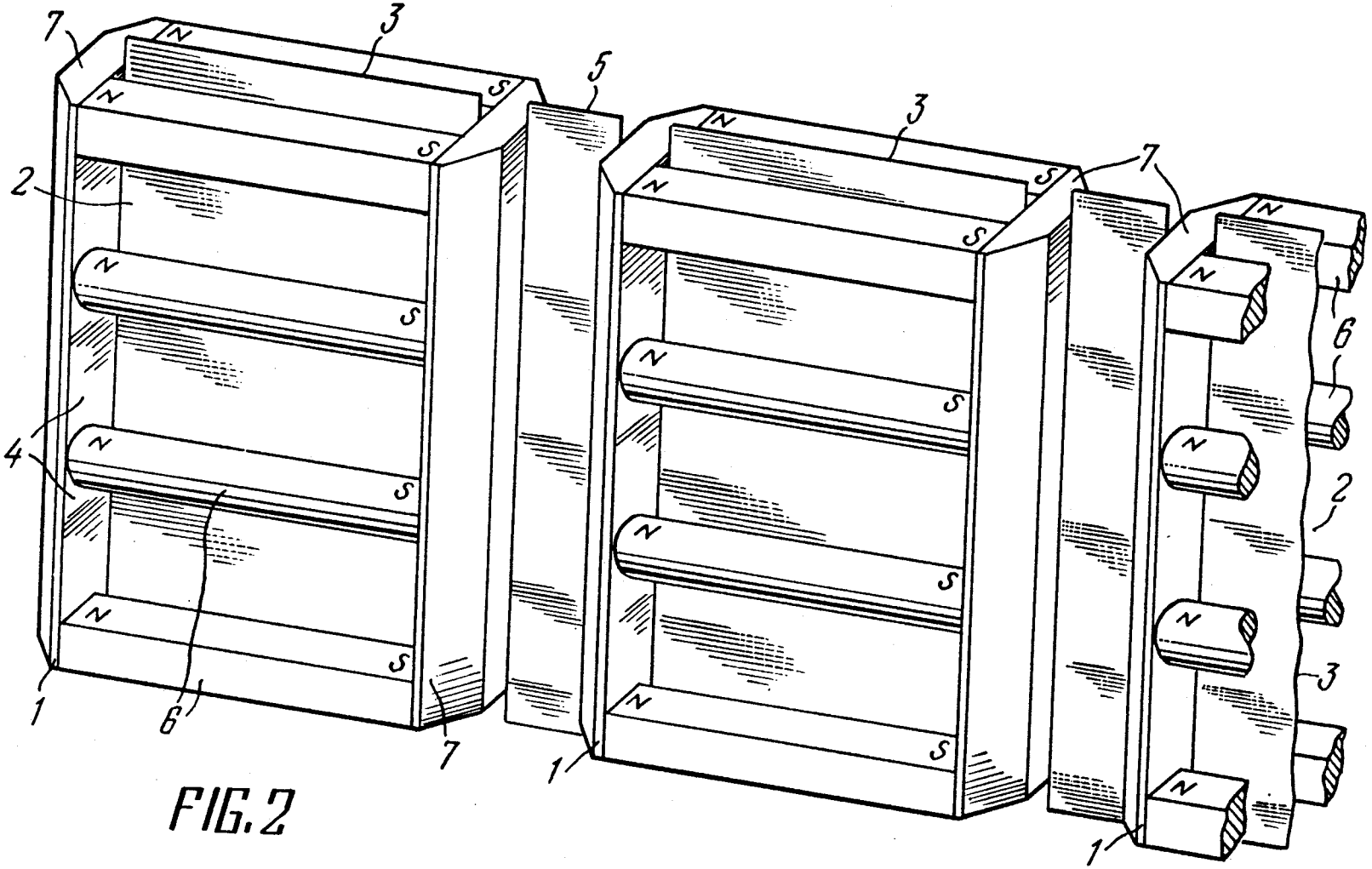
FIGS. 2, 3, 4, 5, 6, 7, 8, show versions of the embodiment of the loudspeaker, according to the invention, general view.

Shown in FIG. 2 is a loudspeaker, in which the side walls are assembled of magnetic rods 6 disposed parallelly and having magnetic axes of the same direction, and rows of the magnetic rods 6 are formed on opposite sides of the ribbon 3. In the row, the rods 6 are spaced by intervals functioning as apertures 4 for sound passage. The rods 6 may be of any cross-section, e.g. rectangular or round. The like poles of the rods 6 are interconnected by means of fasteners, e.g. plates 7 made of a soft magnetic material and serving as pole concentrators, or made of a nonmagnetic material so that an integral construction of the permanent magnet is formed. The internal chamber is limited by the magnetic rods 6 and the fastening plates 7, and the rod intervals form the sound apertures 4.

Figure 3:
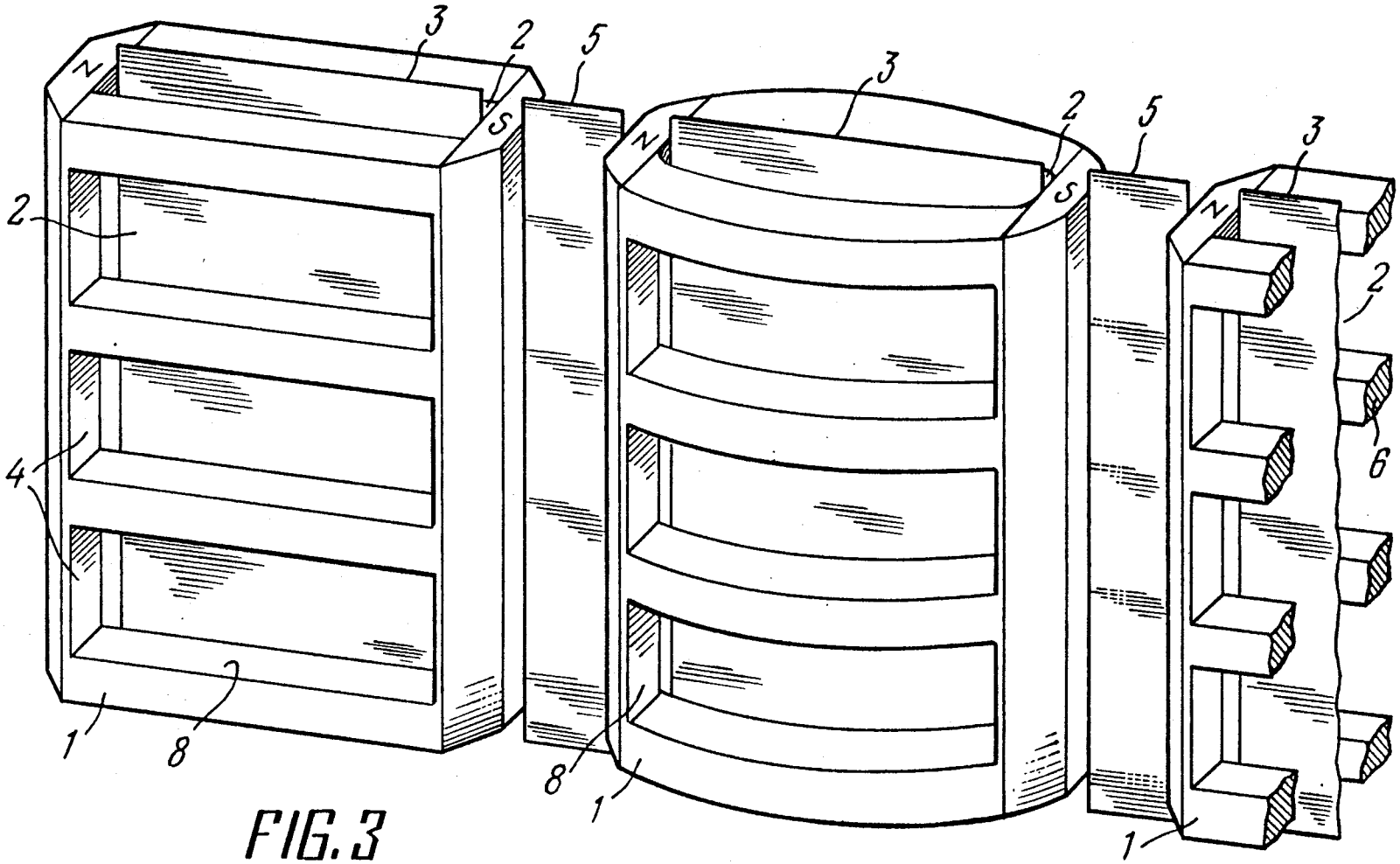

Shown in FIG. 3 is a loudspeaker, in which the side walls are assembled of plates 8 disposed one on either side of the ribbon 3, said plates have perforations functioning as sound apertures 4.

Figure 4:
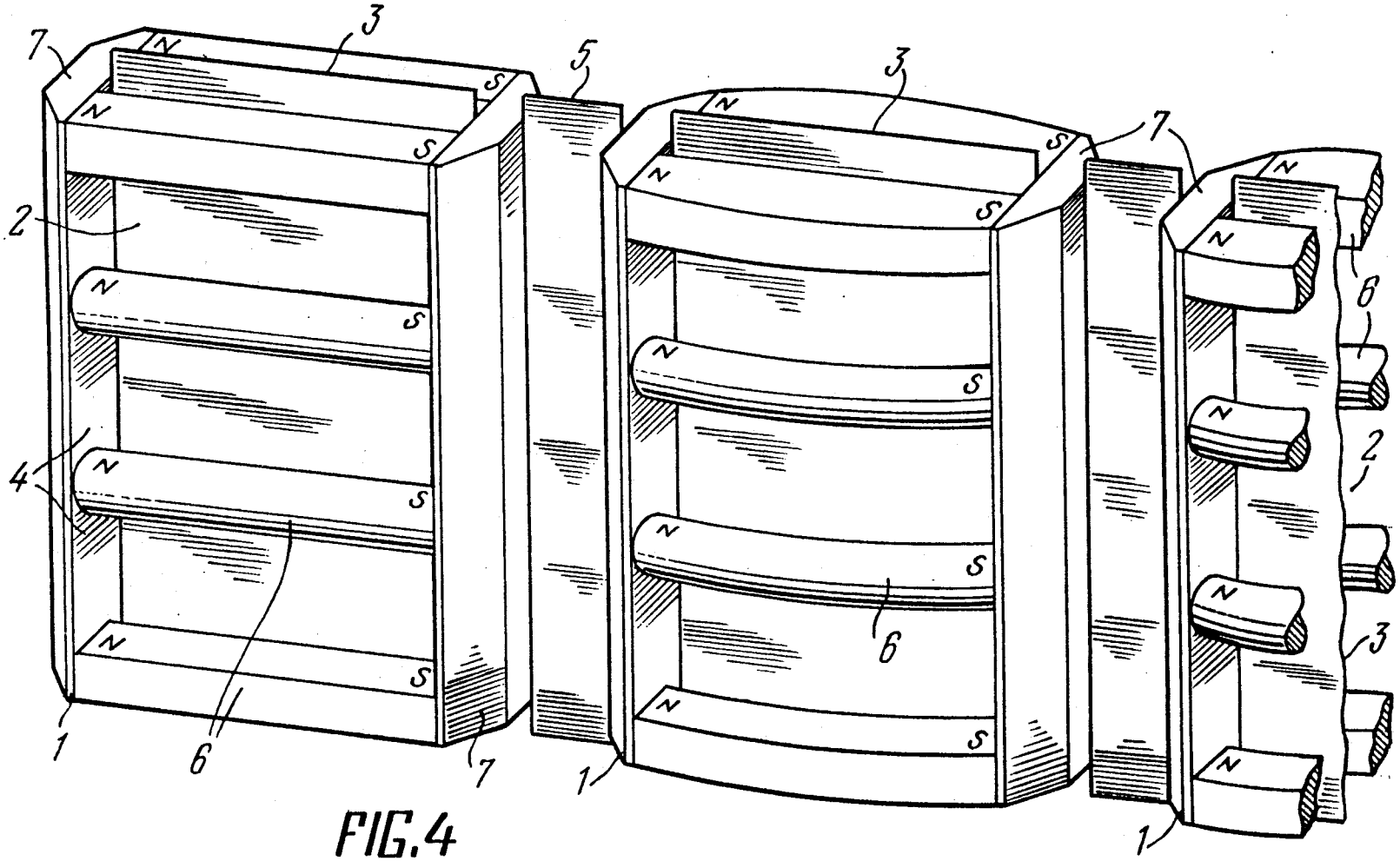

The rods 6 or the plates 8 may be of a variable cross-section, as shown in FIGS. 3 and 4.

Figure 5:
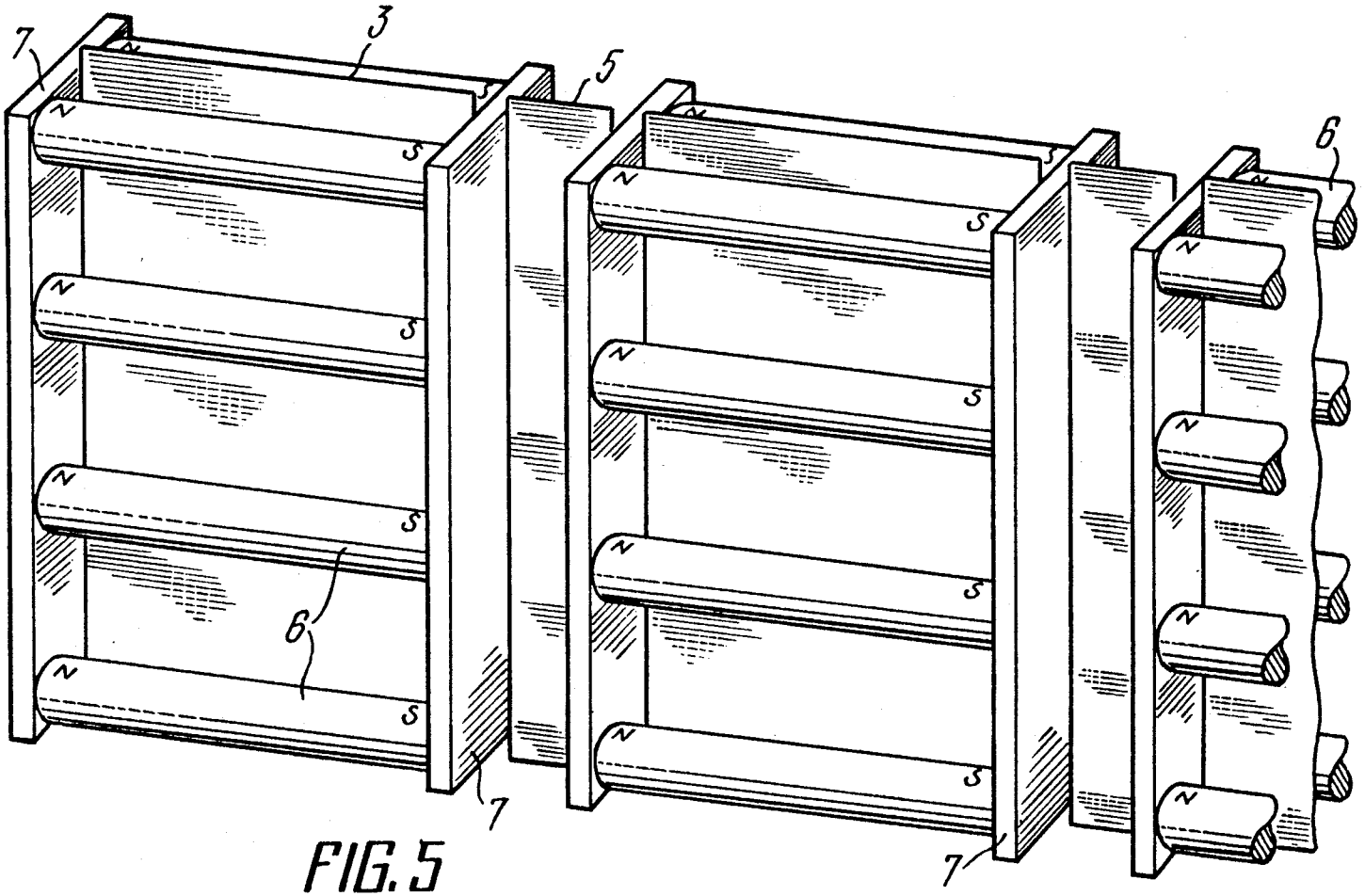

Shown in FIG. 5 is a wide-ribbon loudspeaker, in which the permanent magnet is made in the manner of FIG. 2, but in this case the fastening plates 7 connecting the magnetic rods 6 are made of a nonmagnetic material, and do not function as pole concentrators.

Figure 6:
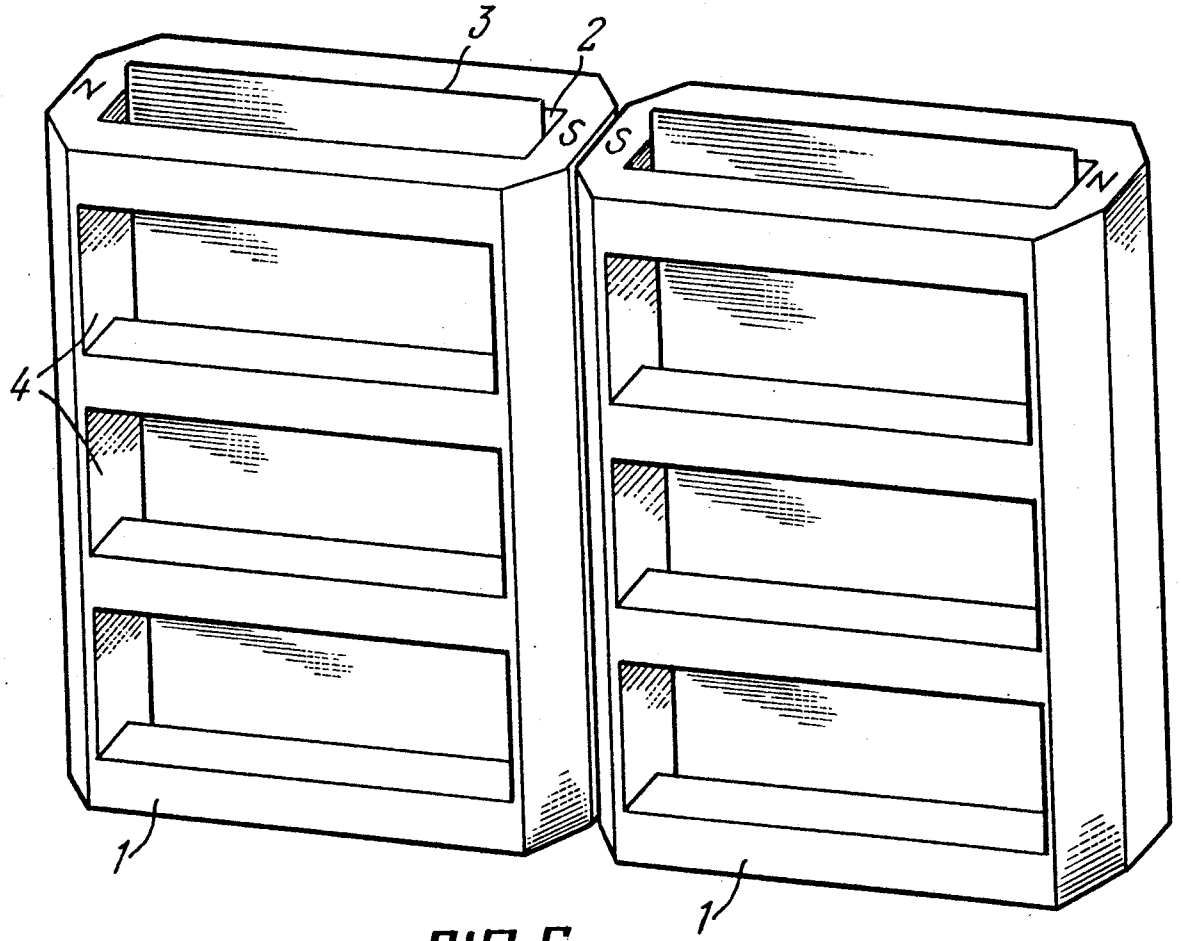

Shown in FIG. 6 in a loudspeaker, in which only the wide ribbon 3 accommodated in the internal chamber 2 of the permanent magnet 1 is employed and the magnets themselves face each other with their poles. This arrangement of the magnets increases the magnetic induction in the internal chambers 2 of the adjacent magnets.

Figure 7:
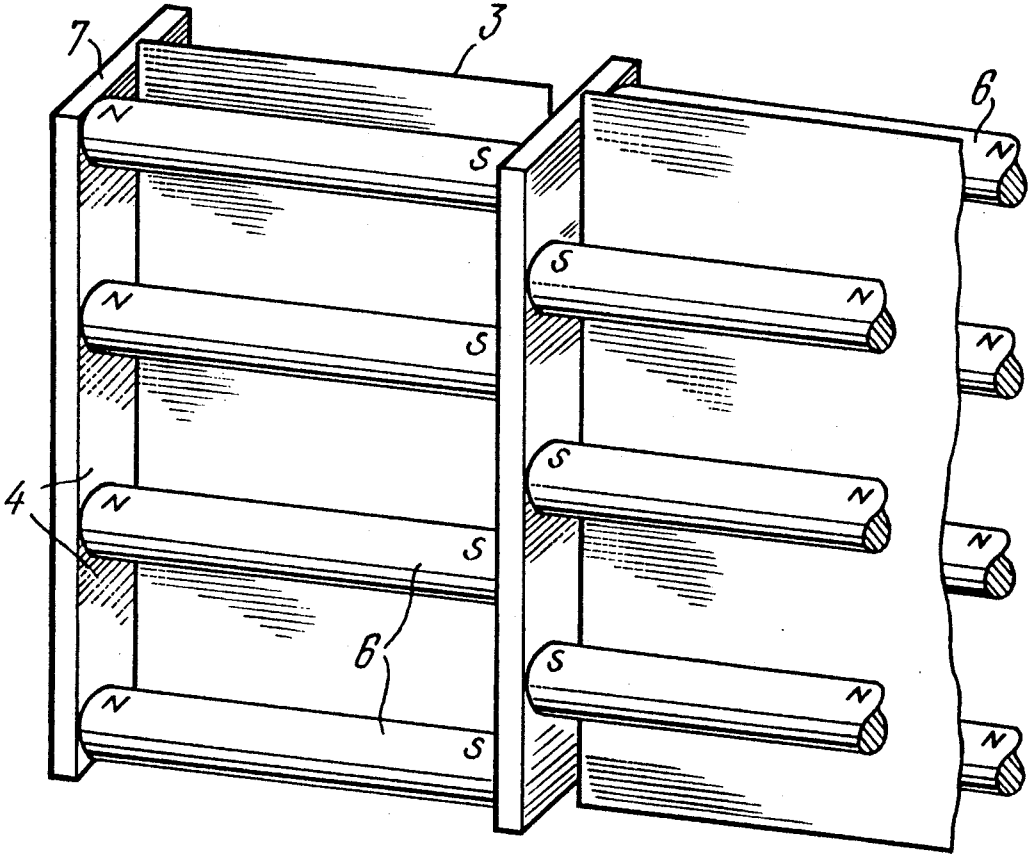

Shown in FIG. 7 is a loudspeaker, in which the magnetic rods 6 forming the side walls of the magnet are so arranged that the rods 6 of one magnet are located against the intervals between the rods of another, adjacent magnet. Said arrangement of the rods improves the uniformity of the magnetic field in the internal chamber of the magnets, saves the magnetic material and reduces the weight of the loudspeaker.

Figure 8:
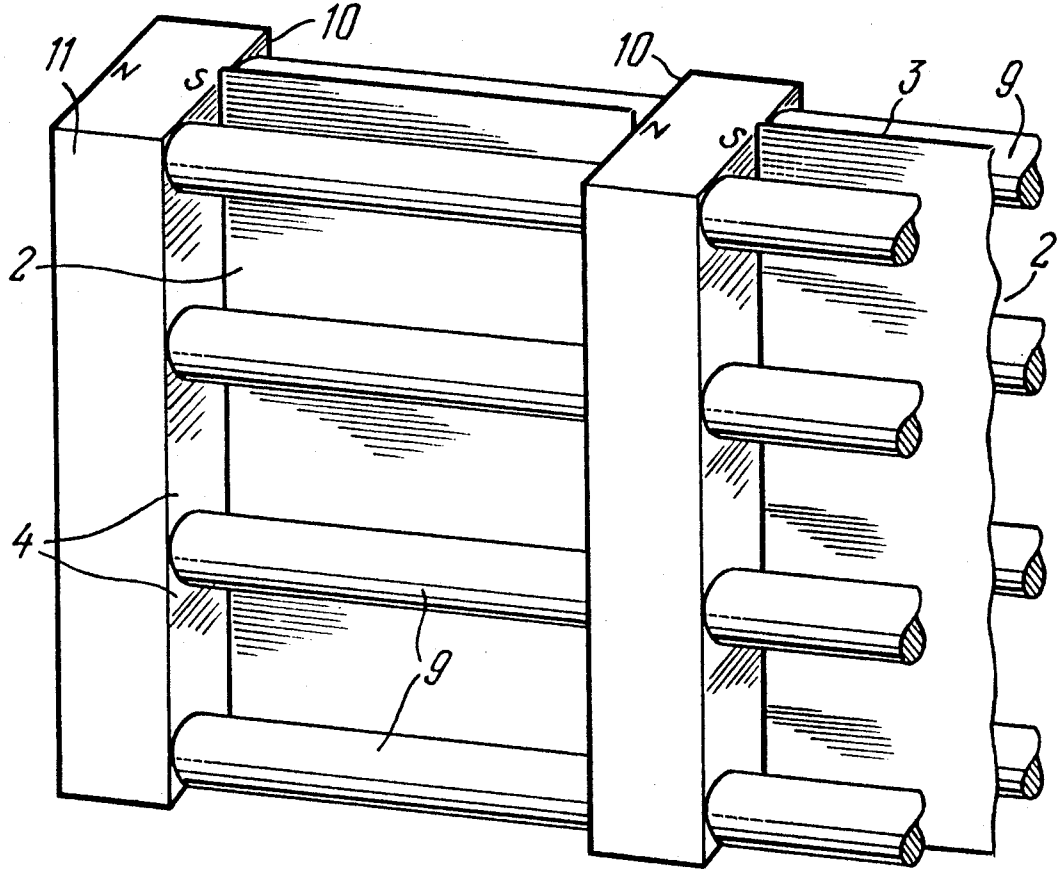

Shown in FIG. 8 is a wide-ribbon loudspeaker, in which the side walls of the magnet are assembled of rods 9 disposed on the side of the wide ribbon 3 surface and made of soft magnetic material. The rods 9 are magnetized on their both ends by the unlike poles 10 of the magnets 11.

The use in the ribbon loudspeaker of permanent magnets comprising an internal chamber which accommodates wide sound ribbons extends the audio-frequency band and improves sound reproduction owing to the increase of the sound intensity in the low-frequency audio band. In addition, it increases, by tens of times, the active sound-radiating area of the loudspeaker.

Industrial Application

The loudspeaker may be used wherever the highest fidelity of sound reproduction is desired—in music halls, studios, cinemas, in high-fidelity household acoustical equipment, as standard specimens of acoustical systems—during examinations for sound reproduction fidelity.

We claim:

1. A wide-ribbon loudspeaker, comprising:

a sound ribbon made of an electrically conductive material and having a first and a second planar surface, a first single hollow permanent magnet having a magnetic axis, side walls, an internal chamber defined by said side walls, and sound apertures, said sound apertures being formed in a first and a second side wall of said side walls and opening into said internal chamber;

said sound ribbon being positioned within said internal chamber and extending in a plane parallel to the magnetic axis, the first planar surface of said sound ribbon being juxtaposed to said first side wall and the second planar surface of said sound ribbon being juxtaposed to said second side wall.

2. A loudspeaker as recited in claim 1 further comprising a second hollow permanent magnet having a magnetic axis, first and second side walls and an internal chamber defined by said first and second side walls, said second hollow permanent magnet having a pole positioned adjacent an opposite pole of said first hollow permanent magnet, said loudspeaker further comprising a second and a third sound ribbon, said second sound ribbon being positioned within the internal chamber of said second hollow permanent magnet and parallel to the magnetic axis of said second hollow permanent magnet, and said third sound ribbon being positioned between the adjacent opposite poles of said first and second hollow permanent magnets.

3. A loudspeaker as recited in claim 2 wherein said first hollow permanent magnet is formed as a unitary integral body and said second hollow permanent magnet is formed as a unitary integral body.

4. A loudspeaker as recited in claim 1 wherein said hollow permanent magnet is formed as a unitary, integral body.

5. A loudspeaker as recited in claim 1 wherein each of the first and second side walls is formed of a series of magnetic rods arranged parallel to one another so as to define said sound apertures therebetween, and said loudspeaker further comprising fasteners, said fasteners being connected to common polarity ends of said magnetic rods.

6. A loudspeaker as recited in claim 2 wherein each of the first and second side walls of said first and second hollow permanent magnets is formed of a series of magnetic rods arranged parallel to one another so as to define said sound apertures therebetween, and said loudspeaker further comprising fasteners connecting together common polarity ends of said magnetic rods in said first and second permanent magnets.

7. A loudspeaker as recited in claim 2 wherein the magnetic rods within said side walls are formed of variable cross sections.

8. A loudspeaker as recited in claim 2 wherein said third sound ribbon has a width extending in a direction between said adjacent hollow permanent magnets that is less than that of said first sound ribbon and less than that of said second sound ribbon.

9. A loudspeaker as recited in claim 1 wherein said first and second side walls are comprised of plates each having a series of perforations formed therein which function as said sound apertures.

10. A loudspeaker as recited in claim 2 wherein said first and second side walls of said first and second hollow permanent magnets are each comprised of a plate having a series of perforations formed therein which function as said sound apertures.

11. A loudspeaker as recited in claim 10 wherein said plates include a series of elongated magnetic sections that are variable in cross section and extend parallel to one another so as to form said sound apertures therebetween.

12. A loudspeaker as recited in claim 1 further comprising a second hollow permanent magnet having a magnetic axis, side walls, an internal chamber defined by said side walls, and sound apertures formed in a first and a second of said side walls, and said loudspeaker further comprising a second sound ribbon positioned within said internal chamber of said second hollow permanent magnet so as to be parallel with said first and second side walls of said second hollow permanent magnet, and said first and second hollow permanent magnets being in contact at a common pole and arranged such that the magnetic axis of said first and second hollow permanent magnets are aligned.

13. A loudspeaker as recited in claim 12 wherein said side walls are comprised of a plurality of magnetic rods arranged in series, and the magnetic rods in said first hollow permanent magnet being spaced at intervals with respect to magnetic rods of a respective side wall in said second permanent magnet.

14. A loudspeaker as reacted in claim 1 wherein said first and second side walls, except for said sound apertures formed therein, present a continuous, planar, and unbroken surface to said sound ribbon.

15. A loudspeaker as recited in claim 1 wherein said sound ribbon has a width which is essentially the same as said sound aperture.

16. A loudspeaker as recited in claim 1 further comprising a second hollow permanent magnet having a magnetic axis, first and second side walls and an internal chamber defined by said first and second side walls, said loudspeaker further comprising a second sound ribbon positioned within the internal chamber of said second hollow permanent magnet, and wherein said first hollow permanent magnet includes first magnetic block fastener, a second magnetic block fastener arranged so as to have an opposite pole facing said first block fastener, and a series of soft magnetic material rods extending between said block fasteners and arranged along a common plane to define said first side wall of said first hollow permanent magnet and a second series of soft magnetic material rods arranged along a common plane to define said second side wall of said first hollow permanent magnet, and said second hollow permanent magnet comprising a first block fastener having an opposite pole facing the second block fastener of said first hollow permanent magnet, a first series of soft magnetic material rods arranged along a common plane to define said first side wall of said second hollow permanent magnetic and extending between said first block fastener of said second hollow permanent magnet and the second block fastener of said first hollow permanent magnet, and a second series of soft magnetic material rods arranged along a common plane to define said second side wall of said second hollow permanent magnet and extending between said first block fastener of said hollow second permanent magnet and said second block fastener of said first hollow permanent magnet.

17. A wide-ribbon loudspeaker, comprising:

a sound ribbon formed of an electrically conducting material and having two side edges and a first and second planar surface; and a first single hollow permanent magnet which includes a magnetic axis, two side edges, and two side walls spaced from one another so as to form an internal chamber therebetween, said side walls having sound apertures formed therein which extend between said two side edges and open into said internal chamber, said first planar surface of said sound ribbon being juxtaposed and parallel to said first side wall and said second planar surface of said sound ribbon being juxtaposed and parallel to said second side wall, and the distance between the side edges of said sound ribbon being essentially equal to the distance said sound apertures extend between the two side edges of said hollow permanent magnet, and the magnetic axis of said first hollow permanent magnet being parallel with the planar surfaces of said sound ribbon.

18. A loudspeaker as recited in claim 17 further comprising a second sound ribbon and a second hollow permanent magnet, said second hollow permanent magnet having two side edges and a first and a second side wall extending therebetween and spaced from one another so as to form an internal chamber in which said second sound ribbon is positioned, said first and second side walls of said second hollow permanent magnet being parallel and spaced from said second sound ribbon, said first and second side walls of said second hollow permanent magnet having sound apertures formed therein, and the second side edge of said first hollow permanent magnet being adjacent the first side edge of said second hollow permanent magnet such that the first and second sound ribbons are aligned along a common plane.

19. A loudspeaker as recited in claim 18 further comprising a third sound ribbon aligned along the common plane and positioned between the second side edge of said first hollow permanent magnet and the first side edge of said second permanent magnet.

20. A loudspeaker as recited in claim 19 wherein said third sound ribbon has a shorter width than that of said first and second sound ribbons.

21. A loudspeaker as recited in claim 17 wherein said hollow permanent magnet includes a top and bottom wall and said internal chamber extends through said top and bottom wall.

* * * * *